US011039722B2

(12) United States Patent
Brown et al.

(10) Patent No.: US 11,039,722 B2
(45) Date of Patent: Jun. 22, 2021

(54) ASSISTED DRIVE FOR SURFACE CLEANING DEVICES

(71) Applicant: SharkNinja Operating, LLC, Needham, MA (US)

(72) Inventors: Andre D. Brown, Natick, MA (US); David S. Clare, London (GB); Nicholas Sardar, London (GB); Christopher P. Pinches, Surrey (GB); Samuel Emrys James, London (GB); Michael James Douglas, London (GB); Jason B. Thorne, Dover, NH (US)

(73) Assignee: SharkNinja Operating LLC, Needham, MA (US)

( * ) Notice: Subject to any disclaimer, the term of this patent is extended or adjusted under 35 U.S.C. 154(b) by 201 days.

(21) Appl. No.: 16/392,480

(22) Filed: Apr. 23, 2019

(65) Prior Publication Data

US 2019/0320865 A1 Oct. 24, 2019

Related U.S. Application Data

(60) Provisional application No. 62/661,504, filed on Apr. 23, 2018.

(51) Int. Cl.
*A47L 9/28* (2006.01)

(52) U.S. Cl.
CPC ..... *A47L 9/2821* (2013.01); *A47L 9/2842* (2013.01); *A47L 9/2852* (2013.01); *A47L 9/2857* (2013.01)

(58) Field of Classification Search
CPC ..... A47L 9/28; A47L 9/2821; A47L 9/2826; A47L 9/2831; A47L 9/2836;
(Continued)

(56) References Cited

U.S. PATENT DOCUMENTS 7,150,068 B1 12/2006 Ragner
8,296,899 B2 10/2012 Veenstra
(Continued)

FOREIGN PATENT DOCUMENTS

CN 105595916 A 5/2016

OTHER PUBLICATIONS

PCT Search Report and Written Opinion dated Aug. 16, 2019, received in PCT Application No. PCT/US19/28798, 9 pgs.
(Continued)

*Primary Examiner* — Robert J Scruggs
(74) *Attorney, Agent, or Firm* — Grossman Tucker Perreault & Pfleger, PLLC

(57) ABSTRACT

In general, the present disclosure is directed to a force-sensing arrangement for use in surface cleaning devices, such as a vacuum device, that allows a user-supplied force to be translated into a command signal to cause the surface cleaning device to accelerate forward, reverse or to veer/turn in a desired direction. In an embodiment, the surface cleaning device includes a nozzle, wheels, motor(s) to drive the wheels, and an upright handle portion. The surface cleaning device includes a force-sensing arrangement with load cells coupled at a position where user force is transferred from the upright portion to the nozzle. The force-sensing arrangement detects the user supplying a relatively small amount of force and translates the same into measurement signals. A controller coupled to the load cells utilizes the measurement signals to determine or "infer" a desired direction of travel.

19 Claims, 10 Drawing Sheets

(58) Field of Classification Search
CPC .... A47L 9/2842; A47L 9/2847; A47L 9/2852; A47L 9/2857; A47L 9/2863; A47L 9/2889; A47L 9/2805; A47L 2201/00; A47L 2201/028; A47L 2201/04; A47L 5/28; A47L 5/30; A47L 5/24; A47L 9/322; A47L 9/325; A47L 9/009; A47L 9/04
See application file for complete search history.

(56) References Cited

U.S. PATENT DOCUMENTS

| | | | | |
|---|---|---|---|---|
| 10,881,257 | B2 * | 1/2021 | Kim | A47L 9/009 |
| 2004/0000023 | A1 | 1/2004 | Hitzelberger et al. | |
| 2007/0094840 | A1 * | 5/2007 | Zahuranec | A47L 5/32 15/328 |
| 2007/0214598 | A1 * | 9/2007 | Zahuranec | A47L 5/28 15/340.2 |
| 2009/0089969 | A1 | 4/2009 | Lee et al. | |
| 2009/0133215 | A1 * | 5/2009 | Zahuranec | A47L 9/325 15/415.1 |
| 2009/0165242 | A1 | 7/2009 | Lee et al. | |
| 2012/0060322 | A1 | 3/2012 | Simonelli et al. | |
| 2017/0020353 | A1 * | 1/2017 | Park | A47L 9/325 |
| 2018/0242807 | A1 | 8/2018 | Lee et al. | |
| 2018/0353035 | A1 * | 12/2018 | Kwak | A47L 9/2805 |

OTHER PUBLICATIONS

Examination Report dated Jan. 5, 2021, received in Application No. GB2017950.3, 3 pgs.

* cited by examiner

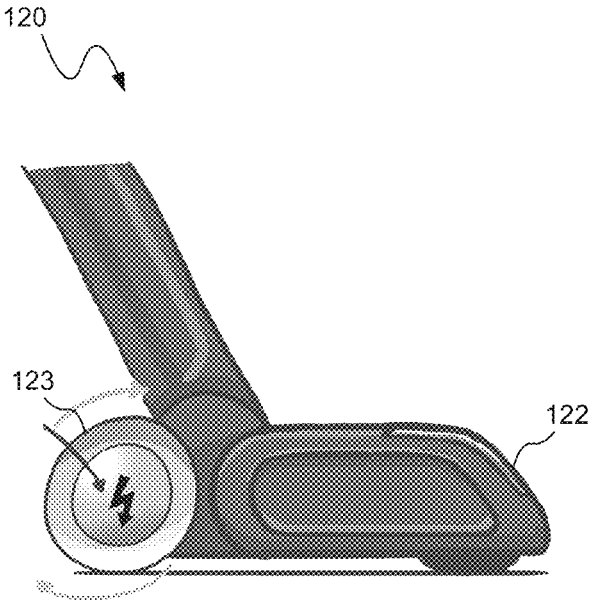
FIG. 1B
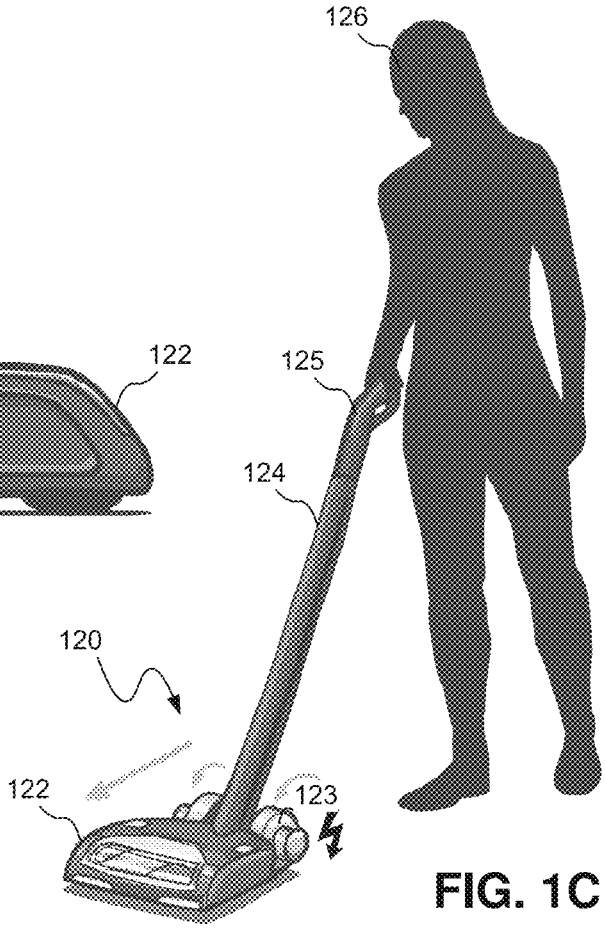
FIG. 1C
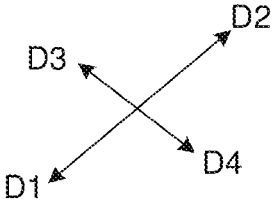

ASSISTED DRIVE FOR SURFACE CLEANING DEVICES

CROSS REFERENCE TO RELATED APPLICATIONS

The present application claims the benefit of U.S. Provisional Patent Application Ser. No. 62/661,504 filed on Apr. 23, 2018, which is fully incorporated herein by reference.

TECHNICAL FIELD

The present disclosure relates to surface cleaning devices such as vacuums, and more particularly, to a drive-assisted surface cleaning device capable of translating user input into a command signal to drive the nozzle in a desired direction to reduce the amount of force a user exerts while performing cleaning operations.

BACKGROUND INFORMATION

Powered devices, such as vacuum cleaners, have multiple components that each receive electrical power from one or more power sources (e.g., one or more batteries or electrical mains). For example, a vacuum cleaner may include a suction motor to generate a vacuum within a cleaning head/nozzle. The generated vacuum collects debris from a surface to be cleaned and deposits the debris, for example, in a debris collector or dust cup. The vacuum may also include a motor to rotate a brushroll within the cleaning head. The rotation of the brushroll agitates debris that has adhered to the surface to be cleaned such that the generated vacuum is capable of removing the debris from the surface. In addition to electrical components for cleaning, the vacuum cleaner may include one or more light sources to illuminate an area to be cleaned.

Vacuum cleaners such as so-called upright vacuums include a handle portion for operating the vacuum during cleaning operations. The amount of force required to push, pull and steer the vacuum varies widely based on, for example, the type of vacuum, the surface to be cleaned and any cleaning elements such as brushes which engage the surface to be cleaned. Users may therefore experience muscle fatigue, e.g., in wrists and arms, after continuous application of such manual force and while supporting a portion of the vacuums weight via the handle portion.

BRIEF DESCRIPTION OF THE DRAWINGS

These and other features and advantages will be better understood by reading the following detailed description, taken together with the drawings wherein:

FIG. 1B shows an example vacuum cleaner device implementing the assisted drive system of FIG. 1A, in accordance with an embodiment.

FIG. 1C shows another perspective view of the vacuum cleaner device of FIG. 1B, in accordance with an embodiment.

DETAILED DESCRIPTION

Figure 1A:
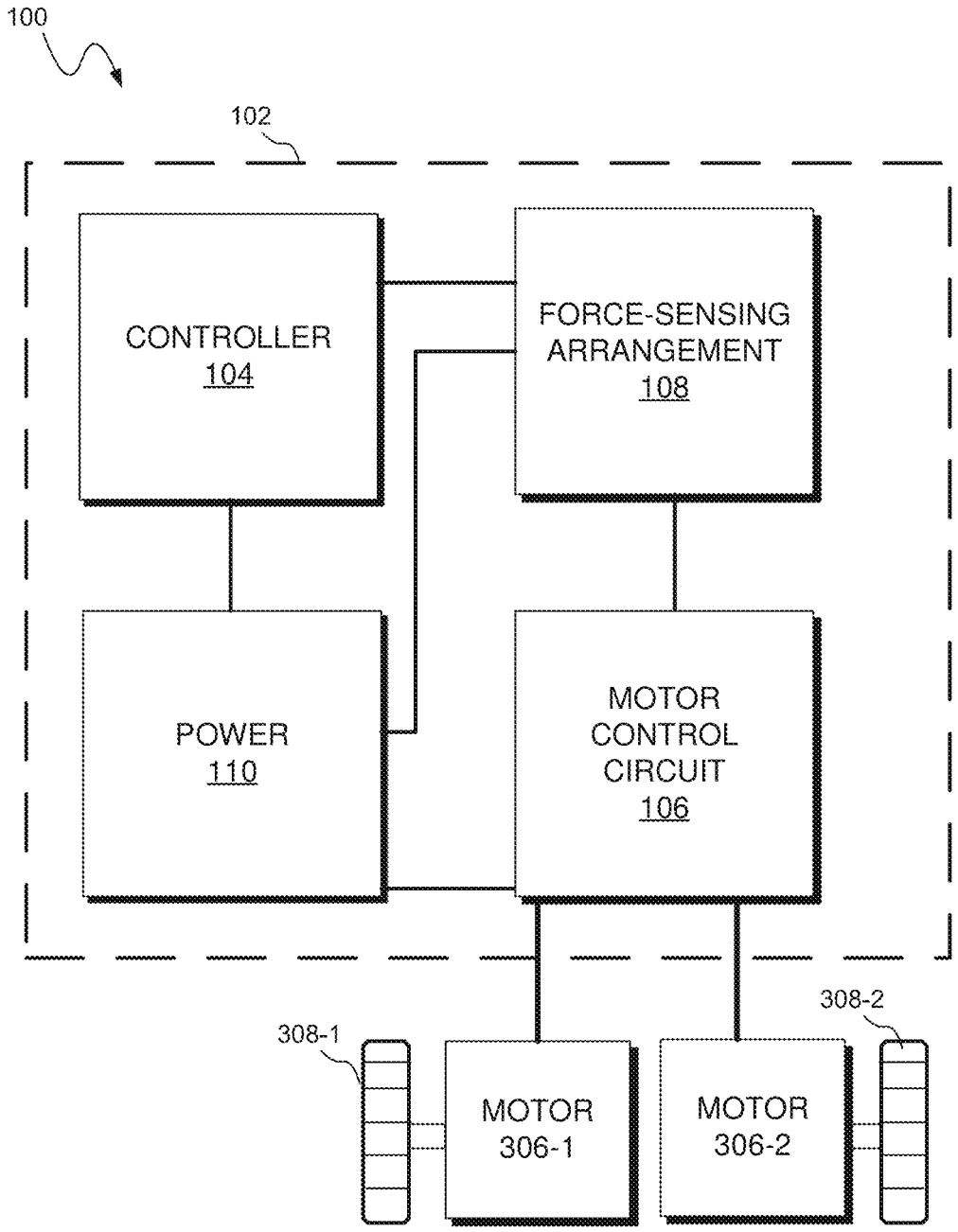
FIG. 1A shows a schematic diagram of an assisted drive system for use in surface cleaning device, in accordance with embodiments of the present disclosure.

In general, the present disclosure is directed to a force-sensing arrangement for use in surface cleaning devices, such as a vacuum device, that allows a user-supplied force to be translated into a command signal to cause the surface cleaning device to accelerate forward, reverse and/or to veer in a desired direction. In an embodiment, the surface cleaning device includes a nozzle, wheels (and/or treads), motor (s) to drive the wheels, and an upright handle portion. The surface cleaning device includes a force-sensing arrangement with load cells coupled at a position where user force is transferred from the upright portion to the nozzle. The force-sensing arrangement detects the user supplying a relatively small amount of force, e.g., relative to the force required to push/pulls/steer a conventional upright vacuum, and translates the same into measurement signals. A controller coupled to the load cells utilizes the measurement signals to determine or "infer" a desired direction of travel. The controller then generates a control signal (also referred to herein as a command signal) to drive the motor and move the surface cleaning device in a desired direction or otherwise adjust cleaning operations. Thus, in a general sense, the force-sensing arrangement allows the surface cleaning device to "sense" the movements of the user based on the user-supplied force and convert the same into control commands.

A surface cleaning device having a force-sensing arrangement consistent with the present disclosure allows for a user to supply a relatively small amount of force to control the surface cleaning device and advantageously minimizes or otherwise reduces muscle fatigue during cleaning operations. In addition, the surface cleaning device can include a force-sensing arrangement consistent with the present disclosure without necessarily changing the aesthetics and function of the surface cleaning device. For example, a vacuum configured with the force-sensing arrangement may appear to have no observable indication that the force-sensing arrangement is present. Accordingly, such a vacuum may be appear to be "standard" and have a handle portion that does not include a visible user input device, such as a sliding portion coupled to the handle or bendable neck, which other surface cleaning device approaches utilize to detect user input. Instead, the vacuum can include the force sensor arrangement proximate the nozzle, and in some cases, integrated into the nozzle housing or otherwise obscured by a cover portion thereof, to obscure the force sensor arrangement from view. Thus, the vacuum may be utilized in an intuitive, conventional way by a user without the visual or mechanical nuisances other surface cleaning devices include to provide drive-assist features.

In addition, a surface cleaning device having a force-sensing arrangement consistent with the present disclosure can allow for selection of operational modes, e.g., sport mode, regular mode, custom mode, and so on. This mode selection may be engaged by a user to change the amount of assistance when detecting and converting the user-supplied force, e.g., the vacuum may accelerate and/or steer more vigorously/rapidly in response to a user force when in sport mode, or less when in a regular mode. The mode may be selectable via an app, or a control of the vacuum, or both. Alternatively, or in addition, the force sensor arrangement can change the assistance amount in proportion to the magnitude of force applied by a user.

In another example embodiment, a vacuum consistent with the present disclosure utilizes a brush-driven drive assist arrangement, also referred to herein as a brushroll drive system, that is configured to accelerate/move the vacuum forward, reverse and to veer in a desired direction based on brushroll communication with the surface to be cleaned. The brush roll drive system utilizes communication, e.g., friction, between a given surface and the brushrolls to "draw" the vacuum in the desired direction. The brush-driven drive assist arrangement can also detect a surface type and extend or retract the brushrolls to increase or decrease such communication with a surface based on the detected surface type. In this embodiment, the vacuum may include at least a first and a second brushroll, with each brushroll being disposed substantially coaxial with each other. This brushroll arrangement may be utilized to generate/create a turning moment, as discussed in greater detail below, to allow user to "veer" to the right or left during cleaning operations. To accomplish the turning moment, each brushroll may be independently driven (e.g., asymmetrically) to cause the vacuum to turn/veer left/right. The signal to move forward, back and veer may be generated based on the force-sensing arrangement disclosed herein. The brushroll drive system disclosed herein allows a surface cleaning device to move without the use of wheels, treads, speed encoders, gears, and so on, which may advantageously reduce manufacturing complexity and costs.

Turning to the Figures, FIG. 1A shows an example assisted drive system 100 for use in a surface cleaning device, consistent with embodiments of the present disclosure. The example assisted drive system 100 can be disposed in a housing 102, such as the nozzle of a vacuum or other suitable location. The example assisted drive system 100 includes a controller 104, a motor control circuit 106, a force-sensing arrangement 108, first and second motors 306-1, 306-2, and first and second wheels 308-1, 308-2. Note, the force-sensing arrangement 108 may also be referred to herein as a force sensor arrangement 108. The embodiment of FIG. 1A is in a highly simplified form for ease of description and clarity. For instance, a surface cleaning device consistent with the present disclosure can an include one or more of a suction motor, floor-type detectors, and other components that may be used in combination with the example assisted drive system 100.

The controller 104 comprises at least one processing device/circuit such as, for example, a digital signal processor (DSP), a field-programmable gate array (FPGA), Reduced Instruction Set Computer (RISC) processor, x86 instruction set processor, microcontroller, an application-specific integrated circuit (ASIC). The controller 104 may comprise a single chip, or multiple separate chips/circuitry. The controller 104 may implement various methods and techniques disclosed herein using software (e.g., C or C++ executing on the controller/processor 104), hardware (e.g., circuitry, hard-coded gate level logic or purpose-built silicon) or firmware (e.g., embedded routines executing on a microcontroller), or any combination thereof. The controller 104 can receive signals, e.g., force measurement signals, from the force-sensing arrangement, as discussed in greater detail below, and can convert the same into control signals to control operation of a surface cleaning device.

The power source 110 comprises any suitable power source capable of generating power at a suitable voltage for use by the controller 104 and force-sensing arrangement 108, for instance. Thus, the power source 110 can include power converters (e.g., DC-DC converters), regulators and other circuitry capable of converting power, e.g., from AC mains, into stepped-down DC signal for use by the components of the surface cleaning device. Alternatively, or in addition, the power source 110 may include one or more battery cells for powering the components of the surface cleaning device.

The motor control circuit 106 comprises any suitable chip/circuitry that can send signals to first and second motors 306-1, 306-2 to independently cause each to drive the first and second wheels 308-1, 308-2, respectively. The motor control circuit 106 may also be configured to command/control other motors, such as those that drive brushrolls/agitators and other components of a surface cleaning device.

The force-sensing arrangement 108 includes at least one force sensor capable of measuring tension or compression forces and outputting a proportional electrical signal. In an embodiment, the force-sensing arrangement 108 includes at least one load cell, such as the load cell shown in FIG. 4. However, other types of force/tensioning sensors are within the scope of this disclosure. As is discussed in greater detail below, the force-sensing arrangement 108 can include load cells disposed proximate a location where an upright handle portion (also referred to as a wand in some applications) connects with, and transfers user-supplied forces, to a nozzle/body of the surface cleaning device.

Thus, a surface cleaning device having a force-sensing arrangement consistent with the present disclosure advantageously provides a relatively transparent sensing approach whereby normal usage, and in particular, normal forces from a user to operate a surface cleaning device can be detected and used to control assistive operations without a user having to necessarily interact with a specialized input device. Simply stated, the force sensor arrangement disclosed herein significantly simplifies user access and full utilization of sophisticated features, e.g., assistive driving, without specialized training or conscious effort.

FIGS. 1B and 1C collectively show the assisted drive system 100 implemented within an example vacuum device 120 in accordance with an embodiment. As shown, the vacuum device 120 includes a base portion 122, wheels 123, and an upright portion 124. The upright portion 124 includes a handle 125 which may be shaped to be comfortably gripped by a user 126. The base 122 may include a nozzle for receiving dirt and debris and a dust cup for storage of the received dirt and debris. The particular configuration shown in FIGS. 1B and 1C is not intended to be limiting and other implementations are within the scope of this disclosure.

The base 122 includes the force-sensing arrangement 108 and is configured to sense movement of the upright portion 124 and convert the same into a force measurement signal. The base 122 or other portion of the vacuum device 120 can include the controller 104 to receive the force measurement signal. In response, the controller 104 provides a signal to drive the wheels 123 in a direction consistent with the force applied by the user 126 and/or to provide a signal to drive brush rolls to cause the vacuum device 120 to move in a direction consistent with the user-supplied force. For instance, the input signal may also be utilized to transition between multiple brushroll speeds and directions to create a torque vector on the base/nozzle, as is discussed in greater detail below. This brush-driven drive assist approach allows the vacuum device 120 to veer/turn based on a relatively small amount of force supplied by a user, e.g., by a user "twisting" their wrist while gripping the handle 125.

In any event, the controller 104 can "infer" a desired movement by a user and drive the vacuum device 120 in a motorized fashion in a plurality of directions including forward (away from the user 126), reverse (towards the user 126), left, and right. Alternatively, or in addition to movement commands, the controller 104 can perform at least one operational change including modification of the nozzle's interaction with a surface to be cleaned (e.g., change height to accommodate different floor types), adjust cleaning element floor engagement, adjust brush roll speed and/or direction, adjust suction power, articulate bristle strips, and/or adjust soleplate geometry.

In an embodiment, the user input detected by the controller 104 can be used to detect a desired action to perform. For instance, the user input may indicate a particular scrubbing action is desired based on a user performing a wrist-flick or other predefined gesture. In one specific example, a user may provide a relatively quick back and forth motion, and in response thereto, the controller 104 may generate a signal that causes one or more of the aforementioned operational changes. The vacuum device 120 may be configured to recognize a plurality of so called real-world gestures, e.g., a scrubbing motion, and may be trained to adjust cleaning operation accordingly. For example, the user input may be identified by the controller 104 as a predefined gesture, and in response to identifying a predefined gesture, the vacuum device 120 can raise/lower a cleaning element to perform 'scrubbing' on a particular region of interest to be cleaned. The cleaning element may comprise an attachment or tool, for example, and the tool may be automatically deployed in response to detection of the predefined gesture.

In one specific example embodiment, the 'style' a user employs while operating the vacuum device 120 may be learned over time and used to train the vacuum device 120. For example, the vacuum 120 may 'learn' that a user prefers a particular mode, e.g., sport, normal, etc., and may vary the responsiveness of the assistive drive and/or operational changes based on learned preferences.

Figure 2:
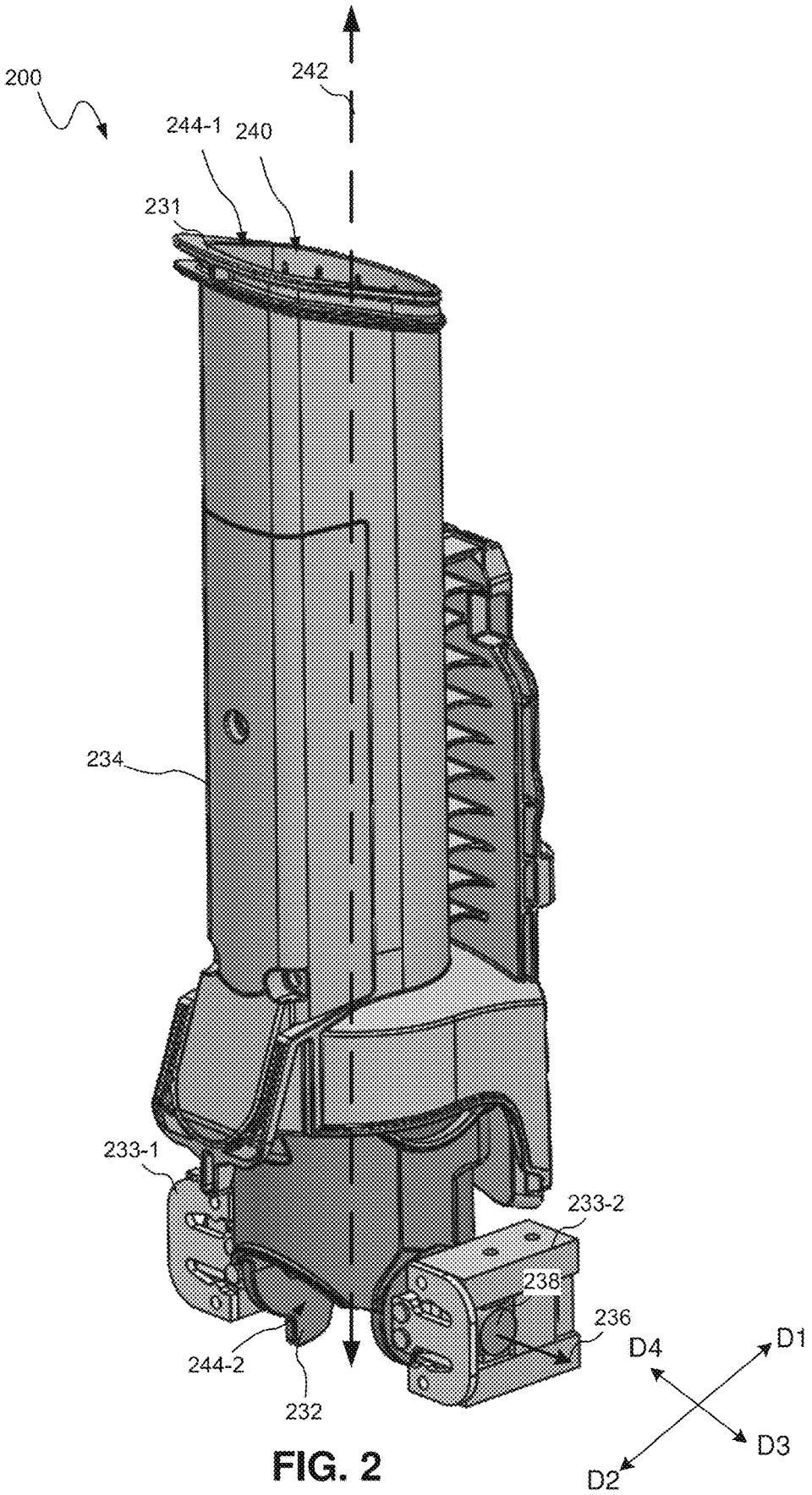
FIG. 2 shows an example swivel base and handle-coupling portion of a surface cleaning device that implements the assisted drive system of FIG. 1, in accordance with an embodiment.
Figure 3A:
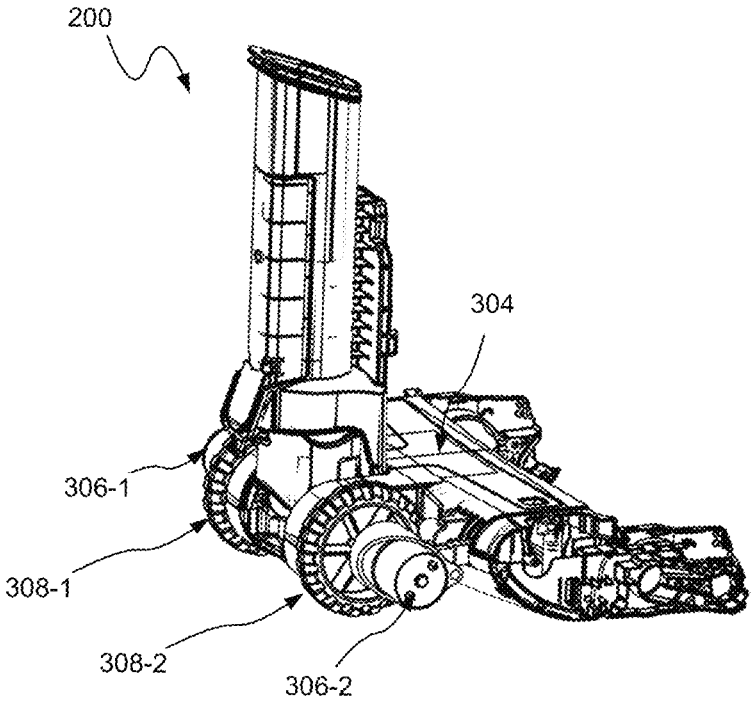
FIG. 3A shows the example swivel base and handle coupling portion of FIG. 2 implemented in a partially-exploded upright vacuum device, in accordance with an embodiment of the present disclosure.
Figure 3B:
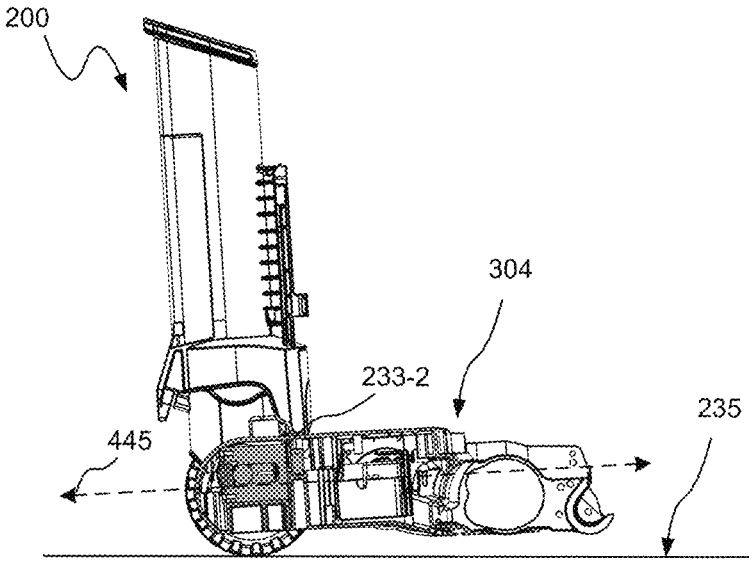
FIG. 3B shows a cross-sectional view of the partially-exploded upright vacuum device of FIG. 3A, in accordance with an embodiment of the present disclosure.

Turning to FIGS. 2-3B, with additional reference to FIGS. 1A-1C, a force-sensing arrangement 200 is shown coupled to a swivel base and handle-coupling portion of a surface cleaning device, in accordance with an embodiment of the present disclosure. The force-sensing arrangement 200 includes a handle/upright coupling portion 231, a swivel base portion 232, and first and second load cells 233-1 and 233-2. In an embodiment, the first and second load cells 233-1 and 233-2 may be electrically coupled to the controller 104 (FIG. 1) within the housing section 234, although the controller 104 may be disposed at a different location depending on a desired configuration.

The handle coupling portion 231 defines a cavity 240 that extends along a longitudinal axis 242 of the handle coupling portion 231. A first end 244-1 of the cavity is configured to at least partially receive and couple to a handle, e.g., handle 125 (FIG. 1B). The second end of the cavity 244-2 is at least partially defined by the swivel base 232.

The swivel base 232 extends from the handle coupling portion 231 and at least partially defines the cavity 240. The swivel base 232 includes a body that defines at least one projection (or axle), e.g., projection 238, that extends substantially transverse relative to the longitudinal axis 242, and preferably, at least two projections that extend opposite from each other. The projections of the swivel base 232 may be substantially coaxial and thus may collectively form a single axle. The projections are configured to extend into a cavity of the load cells 233-1, 233-2, for force sensing purposes as is discussed in further detail below.

As shown, the first and second load cells 233-1, 233-2 are securely attached to the nozzle 304 (See FIG. 3A) and allow for the swivel base portion 232 to move in a plurality of directions based on user input. The first and second load cells 233-1 and 233-2 securely attached to the nozzle 304 proximate the surface to be cleaned 235 ensures that the measurements get taken parallel or substantially parallel with the same, which advantageously reduces the influence of mass on those measurements. This position particularly well suited for such measurements as the sensing axis 445 remains naturally oriented with the floor plane. Moreover, the point where load is transferred from the user 126 into the nozzle 304 is the interface with the swivel base portion 232. The two load cells 233-1, 233-2 can be placed at this interface/fulcrum such as shown. Parallel to the floor and aligned on axis 236 (FIG. 2A) via project 238, results in each load cell 233-1, 233-2 being particularly sensitive to forces applied in a forward/backward direction D1/D2.

This arrangement of sensors 233-1 and 233-2 may be referred to as a symmetric sensor arrangement. In an embodiment, the output of the first and second load cells 233-1 and 233-2 is provided to the controller 104 in the form of force measurement values. The controller 104 may then receive the output and take an average of each load cell's output as force is supplied by the user 126 to establish if forward/back movement has been detected. Likewise, the difference between the output values of each load cell may be used to estimate a value representing turning torque to cause a veering movement to the right or left, as is discussed in further detail below.

Thus, and in accordance with an embodiment, force and/or torque supplied by a user on the upright portion 124 (FIG. 1B), and more specifically, the handle 125, may be measured by the force-sensing arrangement 200. In operation, the force-sensing arrangement 200 therefore allows the user 126 to direct the vacuum device 120 across the floor/ surface to be cleaned based at least in part on forward/back motion and/or turning motions.

Figure 4:
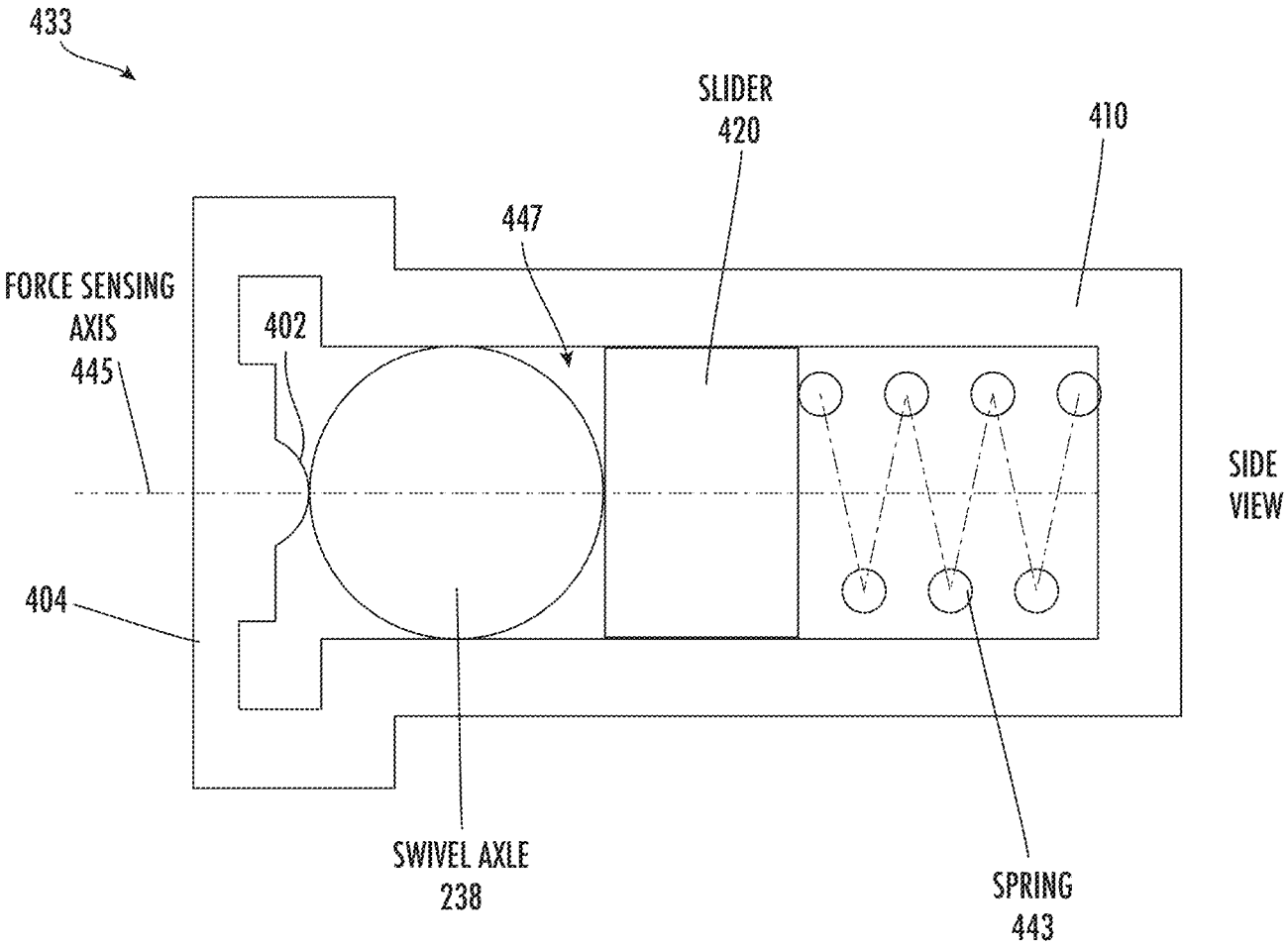
FIG. 4 is a schematic representation of an example load cell consistent with embodiments of the present disclosure.

FIG. 4 shows an example schematic view of a load cell 433 suitable for use in the force-sensing arrangement 200 of FIG. 2. As shown, the load cell 433 includes a load sensor 402 coupled to sensor plate 404, a frame (or housing) 410, a sliding engagement member 420, an opening 447, and a spring device 443. The opening 447 is configured to receive at least a portion of the swivel axle 238.

In an embodiment, the load sensor 402 comprises a strain gauge, although other force/torque measuring devices are within the scope of this disclosure. The spring device 443 supplies a biasing force towards the swivel axle 238 which maintains the sliding engagement member 420 against the swivel axle 238. Therefore, the sliding engagement member 420 may be spring-loaded based on the spring device 443. The frame 410 allows for horizontal movement of the swivel axle 238, e.g., along the force sensing axis 445, but otherwise prevents vertical movement of the swivel axle 238. As shown, the force provided by the spring device 443 maintains the load sensor 433 in a neutral state (e.g., by applying a substantially constant amount of force) whereby the force sensor 402 outputs a measurement in a predefined range, and preferably, substantially a center of the predefined range, so that force may be sensed in both directions along the sensing axis 445.

Therefore, two independent force measurements may be received by the controller 104 to determine a desired/target direction of movement. In particular, the first and second load cells 233-1, 233-2 may be utilized to measure force/torque based on the movement of the swivel axles. As is discussed above, each of the first and second load cells 233-1, 233-2 can include a spring-biased (or spring-loaded) sliding engagement member 420 that applies a predefined amount of force in a neutral state. Movement of the swivel axles thus results in first and second measurement signals from the first and second cells 233-1, 233-2, respectively, to deviate/shift from the predefined amount of force provided in the neutral state, and thus, allows the controller 104 to identify a desired/target direction.

In more detail, the measured force/torque signal output by the first and second load cells 233-1, 233-2 may then be received by the controller 104 and used to infer or otherwise identify a desired direction of travel. For example, consider a scenario whereby the user 126 applies a force to cause the vacuum device 120 to travel straight forward along direction D1 (See FIG. 1C). In this scenario, the first and second measurement signals from the first and second load cells 233-1, 233-2, respectively, can indicate a substantially equal amount of force being applied in the same direction, i.e., direction D1. Also in this scenario, the first and second signals from the first and second load cells 233-1, 233-2 indicate a measured force value that is less than the steady-state or neutral force value. This reduction of measured force occurs in response to the upright portion 124 pushing the swivel axles away from the force sensor 402.

The opposite holds true in scenarios where a user applies a force to cause the vacuum device 120 to travel straight backward along direction D2. In this scenario, the swivel axles travel towards the sensor 402 of each of the first and second load cells 233-1, 233-2, which then causes the same to output first and second signals, respectively, that indicate a measured force value that is greater than the predefined neutral force value.

In any such cases, the controller 104 can infer/identify the target direction is straight forward along D1 or straight backward along D2, and in response to identifying the target direction can generate a movement command. The movement command may then be provided to the motor control circuit 106, for example, to cause the same to drive the wheels, and by extension the vacuum device 120, forward or backward as the case may be.

Now consider a scenario wherein the user 126 applies a torque force to the upright portion 124 to cause the vacuum device 120 to veer or otherwise change direction. In this scenario, the first and second load cells 233-1, 233-2 output measurement values that are substantially equal in magnitude relative to the predefined neutral force. However, the direction of the torque results in one of the load cells outputting a force value greater than the predefined neutral force value and the other load cell outputting a force value less than the predefined neutral force value. The controller 104 can therefore identify if veering in a different direction is desired based on the output signals of the first and second load cells 233-1, 233-2 indicating opposite directionality of measured forces, e.g., based on the first and second load cells 233-1, 233-2 outputting respective measurement values that are greater than and less than the predetermined neutral force, respectively, or vice-versa.

In addition, the particular target direction to veer/turn towards can be determined based on which load cell outputs a measured force greater than the predetermined neutral force value. For instance, veering toward direction D3 (See FIG. 1C) can result in the second load cell 233-2 outputting a measured force value that is greater than the predetermined neutral state value. On the other hand, in this example the first load cell 233-1 outputs a measured force value that is less than the predetermined neutral state value. The controller 104 can therefore determine the user 126 desires to veer or turn towards direction D3, e.g., to the left, based on the second load cell 233-2 measuring force greater than the predetermined neutral state force, and the second load cell 233-2 measuring a force less than the predetermined neutral state value. In instances where the user desires to reorient the vacuum device 120 in a different direction, the controller 104 can receive the torque measurements as discussed above and assist the user by causing the motor control circuit 106 to drive the associated wheels such that the nozzle of the vacuum 120 pivots in place. This pivoting may be accomplished by the controller 104 sending a command to the motor control circuit 106 to drive one the wheel to the exclusion of the other, thus resulting in a pivoting movement.

In addition, the controller 104 can utilize the magnitude of the measured force values from the first and second load cells 233-1, 233-2, to also command the motor control circuit 106 to move/accelerate the vacuum device 120 forward, or backward, while also veering/turning in a target direction. For example, in a prior example provided above the user 126 veered towards direction D3, which is to say to the left. At the same instance in time the user may also be supplying a force to push the vacuum device 120 forward. The magnitude of the measured force, e.g., relative to the predetermined neutral force, can therefore be utilized by the controller 104 to also vary the speed of movement of the vacuum device while performing the veering movement.

Figure 5A:
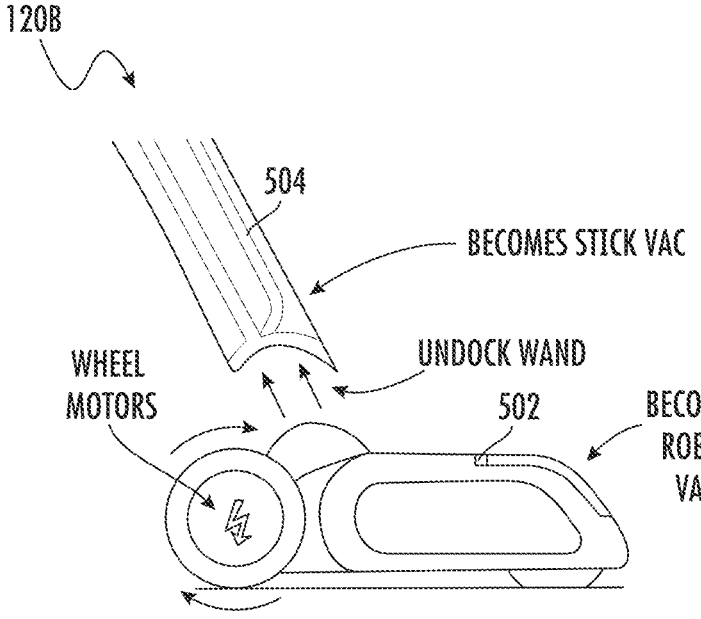
FIG. 5A shows a vacuum device with a detachable upright portion consistent with an embodiment of the present disclosure.
Figure 5B:
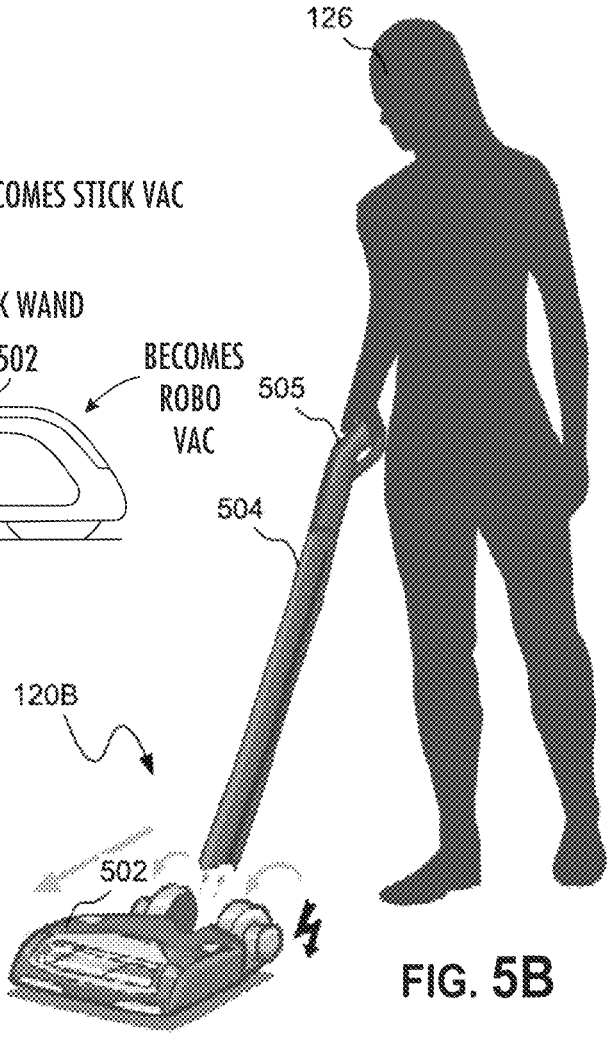
FIG. 5B shows another perspective view of the vacuum device of FIG. 5A consistent with an embodiment of the present disclosure.

FIGS. 5A and 5B show another example embodiment of a vacuum device 120B consistent with the present disclosure. The vacuum device 120B may be configured substantially similar to that of the vacuum device 120A of FIGS. 1B and 1C, the description of which is equally applicable to the vacuum device 120B and will not be repeated for brevity. However, the vacuum device 120B includes a detachable upright portion 504. The user 126 may therefore detach/ decouple the upright portion 504 from the base 502. The upright portion 504 may then be optionally used to remotely control the base portion 502 by the user 126. The base portion 502 can then operate as a robotic vacuum device to perform autonomous, semi-autonomous, and/or manual cleaning based on remote input. The remote input may be provided by movement of the upright portion 504, e.g. the user simulating cleaning motions or performing other predefined gestures. In an embodiment, the upright portion 504 may be implemented as the hand-held surface cleaning device disclosed and described in the co-pending application entitled "HAND-HELD VACUUM WITH ROBOTIC VACUUM CONTROL ARRANGEMENT" which is incorporated by reference herein in its entirety. In this embodiment, the detachable portion may be simply the handle 505, and this disclosure is not intended to be limiting in this regard.

Figure 6A:
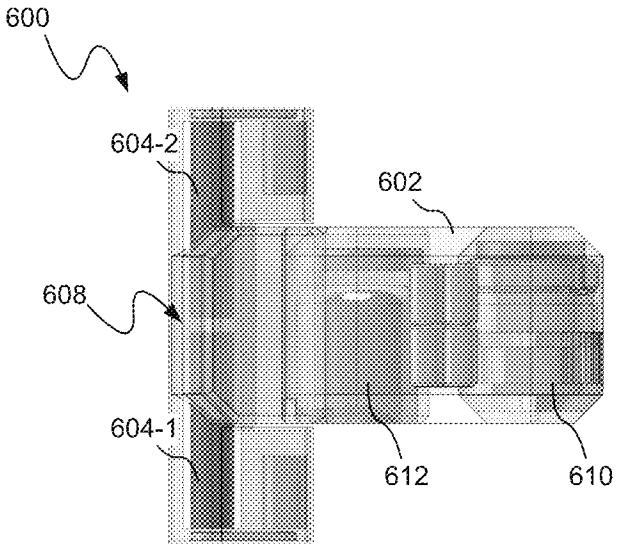
FIG. 6A shows a top-down view of an example surface cleaning device implementing a brush-driven drive assist arrangement consistent with embodiments of the present disclosure.
Figure 6B:
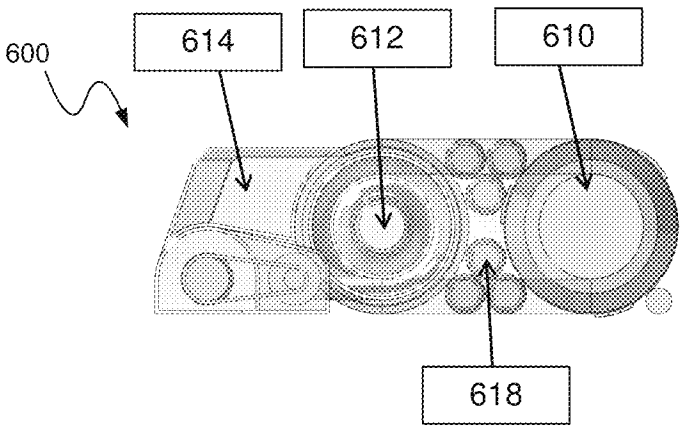
FIG. 6B shows a side view of the example surface cleaning device of FIG. 6A in accordance with an embodiment.

Although the aspects and embodiments discussed above include a vacuum device with wheels and associated circuitry/motors for driving the same, this disclosure is not limited in this regard. For example, FIGS. 6A and 6B show an example vacuum device 600 with a brushroll driving scheme that may be used alone, i.e., without the necessity of wheels/tracks, to drive/propel the vacuum device. Utilizing the brush rolls exclusively in this manner may reduce the number of components, e.g., eliminate the need for gears, wheels/tracks, gear boxes, speed encoders, suspension arrangements, etc., which may advantageously reduce manufacturing complexity and cost.

The vacuum device 600 may be implemented as an upright vacuum device, e.g., vacuum device 120A (FIGS. 1B-1C) and/or vacuum device 120B (FIGS. 5A-5B). The vacuum device 600 can also be implemented as a robotic vacuum that includes circuitry and software/firmware to support autonomous (or semi-autonomous) cleaning operations/modes. Preferably, the robotic vacuum 600 can operate in a plurality of modes including in an upright mode with drive-assisted functions, as discussed above with regard to FIGS. 1A-3B, a remote-controlled mode as discussed above with regard to FIGS. 5A and 5B, and/or a fully or partially autonomous robot vacuum, e.g., with autonomous navigation circuitry.

As shown, the vacuum device 600 includes a housing 602 and a plurality of brushrolls, e.g., first and second brushrolls 604-1, 604-2. The first and second brushrolls 604-1, 604-2 are disposed substantially coaxial with each other. The vacuum device 600 further includes a vacuum motor 610, cyclonic member 612, batteries 618 and a dust cup 614. The vacuum device 600 may further include the controller 104 (See FIG. 1A) that can provide a signal to each of the first and second brushrolls 604-1, 604-2 by way of the motor control circuit 106 to independently control each. The controller 104 may therefore cause the vacuum device 600 to accelerate forwards, backwards and to veer via differential engagement of the first and second brushrolls 604-1, 604-2 on a surface to be cleaned to provide friction/traction and turning movements. This differential arrangement may also be referred to as a brush-driven drive assist arrangement. The housing 602 may further be weighted to increase communication and friction with a surface to be cleaned.

In an embodiment, the first and second brushroll 604-1 and 604-2 may be spaced apart to provide a gap 608 there between. The gap 608 may be used to advantageously prevent hair/debris from tangling up with the brushrolls. The gap 608 may be aligned with the vacuum port (or dirty air inlet) and the dust cup such that hair/debris is released continuously off the two brushrolls 604-1, 604-2 into the airstream to eliminate the necessity of removing the brushrolls to clean the hair off.

Figure 9A:
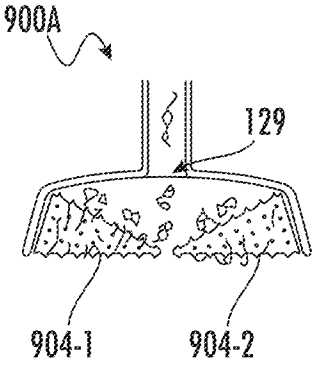
FIG. 9A shows an example brushroll arrangement consistent with aspects of the present disclosure.
Figure 9B:
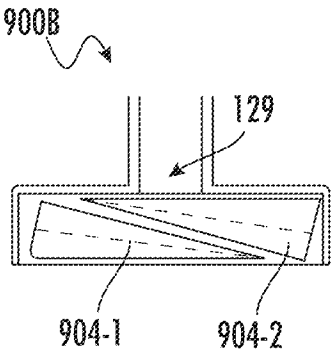
FIG. 9B shows another example brushroll arrangement consistent with aspects of the present disclosure.
Figure 9C:
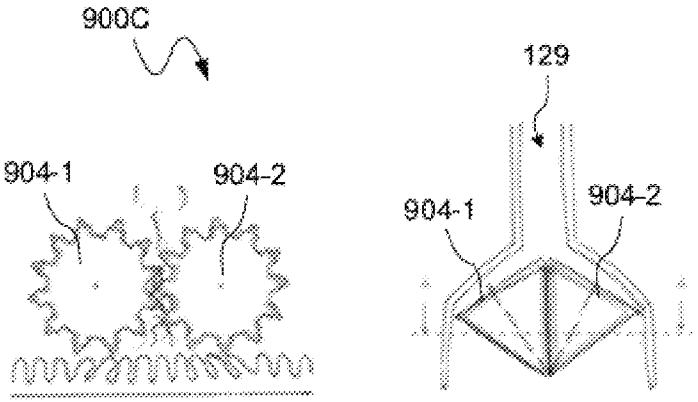
FIG. 9C shows another example brushroll arrangement consistent with aspects of the present disclosure.

The first and second brushrolls 604-1, 604-2 may be fixed or removable from the base 602. The first and second brushrolls 604-1, 604-2 may be driven independently from each other, as opposed to other approaches that utilize a single brushroll or a center driving scheme. The profile and features on each brushroll may be configured such that hair/debris is managed and directed towards the gap in the center. The brushrolls may utilize rubber blades, shielded bristles, and/or the shape/contours of the brush rolls themselves (e.g., a conical shape or other geometric shape). Some additional example embodiments for brushroll configurations to direct hair off of the rolls are shown in FIGS. 9A-9C.

Figure 7:
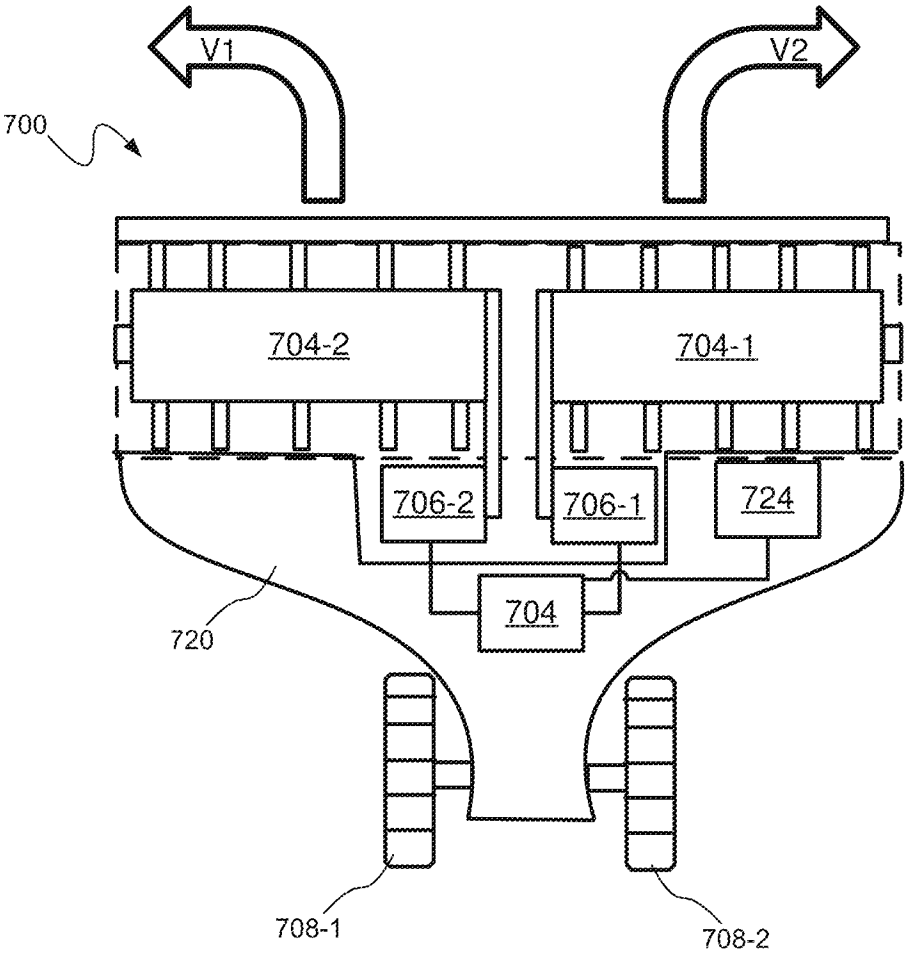
FIG. 7 shows a block diagram that schematically illustrates a vacuum device implementing a brush-driven drive assist arrangement consistent with embodiments of the present disclosure.

Turning to FIG. 7, an embodiment of a vacuum device 700 having a brush-driven drive assist arrangement consistent with the present disclosure is shown. As shown, the vacuum device 700 is shown in a highly simplified form for purposes of clarity and not for limitation. The vacuum device 700 includes a nozzle 720, a controller 704, first and second brushrolls 704-1, 704-2, first and second motors 706-1, 706-2, an optional floor-type sensor 724, and optional first and second wheels 708-1, 708-2.

The first and second brushrolls 704-1, 704-2 are disposed substantially coaxial relative to each other and can be driven independently by first and second motors 706-1, 706-2, respectively. The controller 704 may be implemented similar to that of the controller 104 (See FIG. 1A), and in addition, the controller 704 may implement the force-sensing features as previously discussed to receive user input and convert the same into control commands. In any event, the controller 704 can independently control the speed and rotational direction of each of the first and second brushrolls 706-1, 706-2 based on the control commands interpreted from a force-sensing arrangement consistent with the present disclosure or from other suitable user inputs.

Some aspects of the brush-driven assist drive arrangement may be better understood by way of example. Consider a scenario where a user desires that the vacuum device 700 veers/turns to the left during a cleaning operation. In this scenario, the controller 704 can send a first signal to the first motor 706-1 to cause the same to increase rotational speed or otherwise maintain a current rotational speed. The controller 704 can then send at substantially the same instance in time a second signal to the second motor 706-2 to cause the same to reduce rotational speed. The resulting differential rotational speed between the first and second brushrolls 704-1, 704-2 then causes the same to "draw" or otherwise cause the vacuum device 700 to generate a turning moment based on frictional communication with the surface to be cleaned. This turning moment thus causes the vacuum device 700 to veer/turn towards direction V1. The vacuum 700 can generate a turning moment towards the opposite direction, V2, by sending opposite signals such that the second brushroll 704-2 is driven by a signal to cause a higher rotational speed than that of the rotational speed of the first brushroll 704-1. Note, the vacuum device 700 can include additional motors to optionally drive the first and second wheels 708-1, 708-2 during turning moments to further assist a user when they desire a change in direction during cleaning operations.

In an embodiment, the floor-type sensor 724 can determine a floor type (e.g., wood, carpet, tile). One example sensor suitable for use as the floor-type sensor 724 includes proximity sensors. The floor-type sensor 724 can then output a signal representative of the detected floor type. The controller 104 can receive the output signal from the floor-type sensor 724 and change operation of the vacuum device 700. For example, the controller 104 may disable the brush-roll drive assistance if the detected floor type is wood or otherwise substantially flat. In this instance, a floor type of wood may provide an insufficient amount of friction to utilize the brushroll drive assistance. On the other hand, the controller 104 may cause the first and second brushrolls 704-1, 704-2 via a mechanical lift arrangement (not shown) to extend towards the surface to be cleaned to cause the first and second brushrolls 704-1, 704-2 to engage with the same. Thus, based on the detected floor type the controller 104 may raise or lower the nozzle 720 and/or the first and second brushrolls 704-1, 704-2 relative to the surface to be cleaned in order to decrease or increase frictional communication with the same.

In another example, the controller 104 may detect carpet and reduce the rotational speed of the first and second brushrolls 704-1, 704-2 when performing brushroll drive assistance as the amount of friction between the brushrolls and the carpet fibers can be significantly greater than that of other surface types such as rug-type surface types. Alternatively, or in addition, the controller 104 may raise the first and second brushrolls 704-1, 704-2, via the mechanical lift arrangement to reduce frictional communication with the surface to be cleaned.

Accordingly, a surface cleaning device consistent with the present disclosure can perform cleaning operations on a wide variety of floor types and adjust the frictional contact between the first and second rollers 704-1, 704-2 and the surface to be cleaned to ensure relatively consistent brush-roll-aided movement and user experience when transitioning between multiple different floor types.

Figure 8:
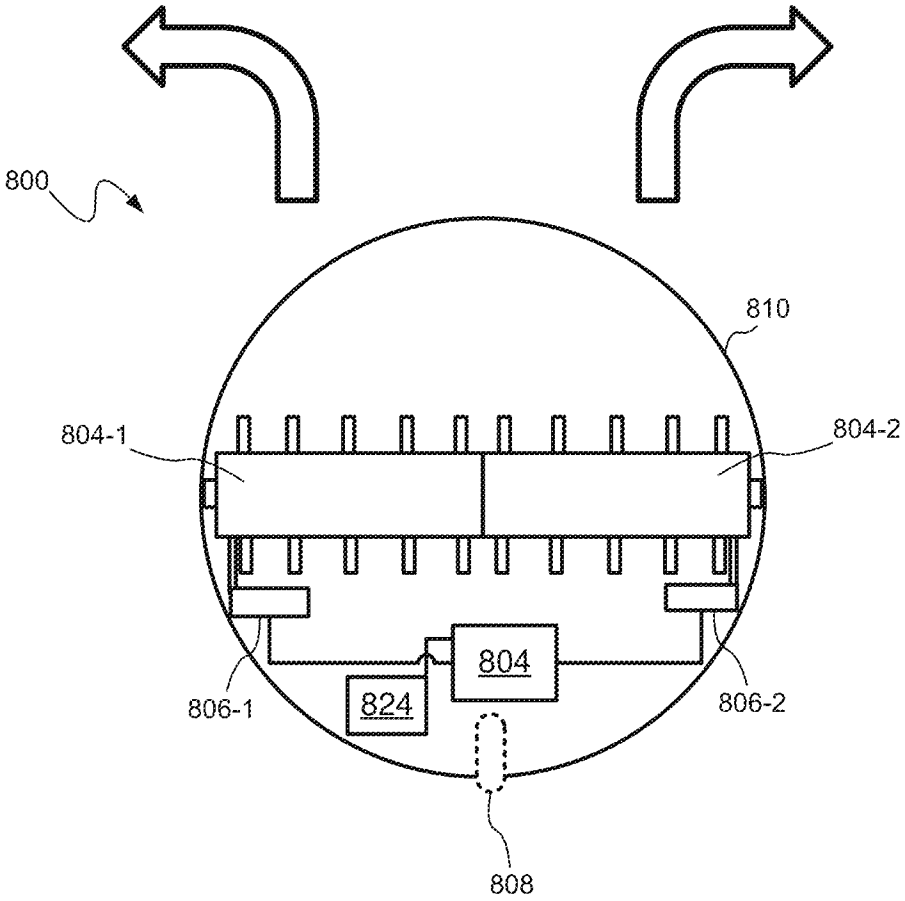
FIG. 8 shows a block diagram that schematically illustrates a robotic vacuum device implementing a brush-driven drive assist arrangement consistent with embodiments of the present disclosure.

FIG. 8 shows an example robotic vacuum 800 implemented with a brushroll-assisted drive system consistent with an embodiment of the present disclosure. The robotic vacuum 800 is shown in a highly simplified form for ease of description and clarity. The robot vacuum 800 includes a housing 810, first and second brushrolls 804-1, 804-2, a controller 804, first and second motors 806-1, 806-2, an optional floor type sensor 824, and an optional pivot wheel 808. The robotic vacuum 800 includes a configuration substantially similar to that of the vacuum device 700, and to this end the teachings of the vacuum device 700 discussed above are equally applicable to the robotic vacuum 800 and will not be repeated for brevity. However, the embodiment of FIG. 8 includes first and second brushrolls 804-1, 804-2 that extend substantially across the diameter of the housing 810 in a so-called "full width" configuration. In addition, the first and second brushrolls 804-1, 804-2 extend substantially across the center of the housing 810.

FIGS. 9A-9D show additional example embodiments of brushroll configurations in accordance with aspects of the present disclosure. The brushroll configurations 900A-900D may be utilized in embodiments disclosed herein including, for example, the vacuum device of FIG. 1B-1C, the robotic vacuum devices of FIG. 6A-6B and FIG. 8.

Turning to FIG. 9A, a brushroll configuration 900A is shown consistent with an embodiment of the present disclosure. In this embodiment, the first and second brushrolls 904-1, 904-2, include a substantially conical shape and are configured to direct hair and debris towards the tapered ends of each brushroll, and ultimately to the gap disposed therebetween that transitions into the dirty air inlet 129.

FIG. 9B shows a brushroll configuration 900B consistent with an embodiment of the present disclosure. As shown, the brushroll configuration 900B includes first and second brushrolls 904-1, 904-2 having a substantially conical shape. In the embodiment of FIG. 9B, the first and second brushrolls 904-1, 904-2 include an overlapping configuration whereby the first and second brushrolls 904-1, 904-2 include longitudinal center lines that extend substantially parallel to each other. This results in a relatively uniform gap that extends between the first and second brushrolls 904-1, 904-2. In addition, the imaginary line representing the longitudinal centerline of each brushroll also denotes a point of contact with the surface to be cleaned.

FIG. 9C shows another example brushroll configuration 900C consistent with an embodiment of the present disclosure. As shown, the first and second brushrolls 904-1, 904-2 are aligned similar to the brushroll configuration 900B, but without a gap extending therebetween. Thus, the bristles/projections of the first and second brushrolls 904-1, 904-2, interact with each other in gear-like fashion to trap and drive hair and debris towards the dirty air inlet 129. The imaginary line that indicates the longitudinal center line of each of the first and second brushrolls 904-1, 904-2, indicates a point of contact with the surface to be cleaned.

Figure 9D:
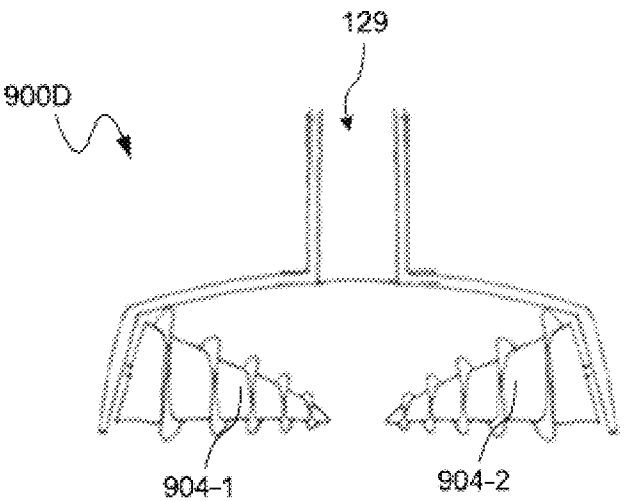
FIG. 9D shows yet another example brushroll arrangement consistent with aspects of the present disclosure.

FIG. 9D shows yet another example brushroll configuration 900D consistent with an embodiment of the present disclosure. As shown, the first and second brushrolls 904-1, 904-2 include a substantially conical shape and bristles that form a helical or screw-like pattern. In addition, a gap extends between the first and second brushrolls 904-1, 904-2.

In accordance with an aspect of the present disclosure a surface cleaning device is disclosed. The surface cleaning device including a base including a nozzle to receive dirt and debris, an upright portion coupled to the base including a handle to be gripped by a user, a force sensor arrangement including at least first and second load cells coupled to the base, the first and second load cells to receive user input during operation of the surface cleaning device and output first and second measurement signals, respectively, and a controller to identify a force applied by the user based on the first and second measurement signals, the controller further to determine a target direction of travel for the surface cleaning device based on the identified force.

In accordance with another aspect of the present disclosure a surface cleaning device is disclosed. The surface cleaning device comprising a swivel base including a nozzle configured to receive dirt and debris, the swivel base having first and second projections extending therefrom that extend substantially parallel relative to each other, an upright portion coupled to the swivel base, the upright portion including a handle to be gripped by a user, and a force sensor arrangement including at least first and second load cells, each of the first and second load cells having an opening to receive the first or second projection, and a sensor to output a force measurement value representative of an amount of force applied by the first or second projection to the sensor in response to the user applying force to the handle.

In accordance with another aspect of the present disclosure a surface cleaning is disclosed. The surface cleaning device comprising a housing having a motor disposed therein to generate suction and a dust cup for storing dirt and debris, a dirty air inlet disposed in the housing for receiving dirt and debris via the generated suction, at least first and second brushrolls disposed proximate the dirty air inlet to agitate the dirt and debris on a surface to be cleaned, at least first and second motors to drive the first and second brushrolls, respectively, and a controller to cause the first motor to drive the first brushroll at a first rotational speed and to cause the second motor to drive the second brushroll a second rotational speed, the first rotational speed being different from the second rotational speed to cause the surface cleaning device to rotate or change a direction of travel.

In accordance with another aspect of the disclosure a surface cleaning device is disclosed. The surface cleaning device comprising a housing having a motor disposed therein to generate suction and a dust cup for storing dirt and debris, a dirty air inlet disposed in the housing for receiving dirt and debris via the generated suction, at least first and second brushrolls disposed proximate the dirty air inlet to agitate the dirt and debris on a surface to be cleaned, at least first and second motors to drive the first and second brushrolls, respectively, and a controller to cause the first motor to drive the first brushroll at a first rotational speed and to cause the second motor to drive the second brushroll a second rotational speed, the first rotational speed being different from the second rotational speed to cause the surface cleaning device to rotate or change a direction of travel.

The surface cleaning device can further comprise a surface type detector to detect a surface type of the surface to be cleaned, and wherein the controller is further to extend the first and second brushrolls towards the surface to be cleaned or to retract the first and second brushrolls away from the surface to be cleaned based on the detected surface type. The surface cleaning device can further have the first and second brushrolls extending substantially coaxial relative to each other. The first and second brushrolls can have a substantially conical shape. The surface cleaning device can be implemented as a robotic vacuum device.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure, which is not to be limited except by the following claims.

What is claimed is:

1. A surface cleaning device comprising:

a base including a nozzle to receive dirt and debris;

an upright portion coupled to the base including a handle to be gripped by a user;

a force sensor arrangement including at least first and second load cells coupled to the base, the first and second load cells to receive user input during operation of the surface cleaning device and output first and second measurement signals, respectively;

a controller to identify a force applied by the user based on the first and second measurement signals, the controller further to determine a target direction of travel for the surface cleaning device based on the identified force;

at least first and second brushrolls;

at least one motor for driving the first and second brushrolls; and wherein, in response to the controller identifying the target direction, the controller is further configured to send a control signal to the at least one motor to drive the first and/or second brushroll and cause the surface cleaning device to move towards the determine target direction based on friction between the first and/or second brushroll and a surface to be cleaned.

2. The surface cleaning device of claim 1, further comprising:

at least first and second wheels;

at least one motor to drive the first and second wheels; and wherein, in response to the controller identifying the target direction, the controller is further configured to send a control signal to the at least one motor to cause the first and/or second wheel to rotate such that the surface cleaning device pivots or turns towards the determine target direction.

3. The surface cleaning device of claim 1, wherein the first and second brushrolls are disposed substantially coaxial with each other.

4. The surface cleaning device of claim 1, wherein the control signal causes the at least one motor to drive the first brushroll at a higher rotational speed relative to the rotational speed of the second brushroll.

5. The surface cleaning device of claim 1, wherein the first and second load cells have a predefined amount of force applied thereto while in a neutral state, and wherein the controller identifies force applied by the user based on the first or second measurement signal indicating a measured force above the predefined amount of force, and the other of the first and second measurement signals indicating a measured force value below the predefined amount of force.

6. The surface cleaning device of claim 5, wherein the first and second load cells include a spring-loaded sliding engagement member to supply the predefined force.

7. The surface cleaning device of claim 1, wherein the base includes swivel axles that couple to and transfer force from the user operating the surface cleaning device via the handle to the first and second load cells for measurement purposes.

8. The surface cleaning device of claim 1, wherein the controller is further configured to detect a force applied by the user to move the surface cleaning device in a forward or reverse direction based on the first and second measurement signals.

9. The surface cleaning device of claim 1, wherein the upright portion is removably coupled to the base such that the user can decouple the upright portion from the base.

10. The surface cleaning device of claim 1, wherein in response to the upright portion being decoupled from the base, the controller causes the surface cleaning device to transition to an autonomous cleaning mode.

11. The surface cleaning device of claim 1, wherein the base and/or cover proximate the base obscures the first and second load cells from view of the user.

12. The surface cleaning device of claim 1, wherein a force sensing axis of the first and second load cells extend substantially parallel relative to each other and substantially parallel with a surface to be cleaned.

13. A surface cleaning device comprising:

a swivel base including a nozzle configured to receive dirt and debris, the swivel base having first and second projections extending therefrom that extend substantially parallel relative to each other;

an upright portion coupled to the swivel base, the upright portion including a handle to be gripped by a user; and a force sensor arrangement including at least first and second load cells, each of the first and second load cells having an opening to receive the first or second projection, and a sensor to output a force measurement value representative of an amount of force applied by the first or second projection to the sensor in response to the user applying force to the handle.

14. The surface cleaning device of claim 13, wherein each of the first and second load cells are configured to supply a substantially constant amount of force in a neutral state to each associated sensor via a spring-loaded sliding member that presses against an associated projection.

15. The surface cleaning device of claim 13, further comprising a controller to identify force applied by a user based on the output of the first and second load cells, the controller configured to generate a control signal to change a direction of travel for the surface cleaning device.

16. The surface cleaning device of claim 15, further comprising:

at least first and second wheels for moving the surface cleaning device on a surface to be cleaned;

a nozzle coupled to the first and second wheels and including at least first and second brushrolls to draw dirt and debris into a dirty air inlet;

at least one motor to drive the first and second wheels and/or the first and second brushrolls; and wherein, in response to the controller identifying force, the controller further determines a target direction and sends a control signal to the at least one motor to cause the first and second wheel to rotate at different speeds relative to each other, and/or sends a control signal to the at least one motor to cause the first and second brushrolls to rotate at different speeds relative to each other such that the surface cleaning device travels towards the target direction based on friction between the brushrolls and the surface to be cleaned.

17. The surface cleaning device of claim 16, wherein the controller is further configured to cause the at least one motor to accelerate the surface cleaning device forward or backward.

18. The surface cleaning device of claim 16, wherein the controller is further configured to cause the at least one motor to accelerate the surface cleaning device forward or backward at a rate proportional to a magnitude of the force measurement values received from the first and second load cells.

19. The surface cleaning device of claim 16, wherein the control signal causes the at least one motor to drive the first brushroll at a higher rotational speed relative to the rotational speed of the second brushroll to cause the surface cleaning device to pivot or turn towards the target direction.

* * * * *